United States Patent [19]

Peterson

[11] 4,256,305

[45] Mar. 17, 1981

[54] HANDLE-EQUIPPED BOWLING BALL

[76] Inventor: Raymond S. Peterson, 415A Tide Harbor, 50 Birdseye St., Stratford, Conn. 06497

[21] Appl. No.: 116,683

[22] Filed: Jan. 30, 1980

[51] Int. Cl.[3] ..... A63B 43/02

[52] U.S. Cl. ..... 273/64; 273/DIG. 20; 273/63 E

[58] Field of Search ..... 273/64, 63 E, DIG. 20

[56] References Cited

U.S. PATENT DOCUMENTS

| | | | |
|---|---|---|---|
| 624,808 | 5/1899 | Howard | 273/64 |
| 838,026 | 12/1906 | Holland | 273/64 |
| 1,079,956 | 12/1913 | Seessle | 273/64 |
| 3,012,784 | 12/1961 | Barker | 273/64 |

*Primary Examiner*—George J. Marlo
*Attorney, Agent, or Firm*—H. Gibner Lehmann; K. Gibner Lehmann

[57] ABSTRACT

A handle-equipped bowling ball comprising a spherical ball body provided with a pair of parallel, spaced-apart bores which are symmetrically disposed with respect to the center of the ball. In the surface of the ball there is a channel that extends between the mouths of the bores. A generally U-shaped handle structure is provided, characterized by parallel leg portions which are slidably movable in the bores of the body, and by a yoke portion that extends between and joins the leg portions, said yoke portion being adapted to occupy the channel in the body so as to present a flush exterior surface when the handle structure is retracted. The handle structure can be extended to a point where stops are engaged, to prevent its further pull-out; it is normally held retracted by coil springs disposed on the leg portions. To prevent unintentional extending of the handle structure against the restraining action of the coil springs when the ball is spinning rapidly, the leg portions are provided with counterweights which essentially counterbalance the centrifugal force on the handle structure. Simple abutment collars coact with the coil springs to prevent deformation of the same, and to cradle the springs for minimizing interference therefrom with the free action of the handle structure.

10 Claims, 8 Drawing Figures

HANDLE-EQUIPPED BOWLING BALL

BACKGROUND

This invention relates to bowling balls, and more particularly to the larger-size balls which are used in connection with the usual tenpins.

In the past an easy-to-hold bowling ball has been produced, wherein a retractable and extendable U-shaped handle is carried in parallel bores made in the ball and in a channel or recess extending between the bores.

One U.S. patent discloses a ball of this type. The handle structure is normally retained in its retracted position by coil springs which are carried on leg portions of the structure. It has been found that with this patented ball construction the handle structure sometimes inadvertently becomes extended when the ball is spinning rapidly. This happens as a rule during the return of the ball to the player, and such occurrence interferes with its normal return movements, resulting in the likelihood of breakage of the handle structure and/or pile-up of the following balls that are being returned.

In this patented ball the coil springs which are carried on leg portions of the handle structure are protected by short sleeves or bushings that are slidably carried thereon and that constitute positive stops functioning at the time the handle structure is in its extended position. By this arrangement, deformation of the springs is prevented and instead a well-defined extension of the handle is had at all times. While these sleeves operated satisfactorily, they constituted additional parts which had to be fabricated, inventoried, and included in the assembly of the handle structure of the ball. This represented an additional expense, not only of material but also of labor and inventory cost.

SUMMARY

The above drawbacks and disadvantages of this prior easy-to-hold bowling ball are obviated by the present invention, which has for one object the provision of an improved bowling ball of this type, wherein the extendable and retractable handle structure is at all times normally maintained in its retracted position against the action of centrifugal forces when not being used to hold the ball.

Another object of the invention is to provide a novel and improved easy-to-hold bowling ball as above characterized, wherein the extended position of the handle structure is precisely defined without the necessity for incorporating additional, separate sleeves or components on the leg portions thereof.

A further object of the invention is to provide an improved bowling ball in accordance with the foregoing, which is especially simple in its construction, utilizing relatively few parts whereby it is economical to fabricate.

A feature of the invention resides in the provision of an improved bowling ball as above set forth, wherein simplified means cradles the coil springs of the handle structure, preventing their deformation and minimizing the likelihood of said springs interfering with the free action of the handle structure.

Another feature of the invention resides in the provision of an improved bowling ball of the kind described above, which is reliable in its operation at all times and especially sturdy whereby it is not likely to malfunction.

In accomplishing the above objects, the invention provides a spherical ball body having a pair of parallel spaced-apart bores which are arranged symmetrically with respect to the center of the ball, said body having a channel in its surface which extends between the mouths of the bores.

A generally U-shaped handle-part is provided, comprising a pair of parallel leg portions and a yoke portion extending between and joining the leg portions. The handle structure is slidable in the bores of the body, and the yoke portion thereof occupies the channel when the handle structure is retracted, so as to present a flush exterior surface.

Threaded bushings that are slidable on the leg portions, are screwed into the bores of the ball, and said leg portions have coil springs and stops which bias the handle structure to its normally retracted position. The coil springs can be compressed as the handle structure is shifted to extended position, until the movement is stopped by virtue of the existence of the stops that are provided. The leg portions of the handle structure carry counterweights which extend into the bores of the ball body and are disposed sufficiently deep to counteract the effect of centrifugal force on the handle structure and minimize the tendency for the same to shift to its extended position against the action of the coil springs as the ball is rapidly spinning.

In one embodiment of the invention the counterweights have integral skirt or collar portions which encircle the legs of the handle structure and the coil springs, said collar portions constituting abutments for engagement with bushings threaded into the ball. Positive stops are thus effected, which come into action when the handle structure is extended.

In another embodiment of the invention the bushings which are threaded into the ball and which constitute bearings for the legs of the handle structure, have integral depending skirts which encircle portions of the legs and the coil springs and which confine the latter when the handle structure is extended, preventing deformation of the springs and interference with the free action of the handle structure.

In still another embodiment of the invention the counterweights are counterbored slightly to provide seats in which end portions of the springs are located, thereby minimizing the likelihood of such springs forcibly engaging the walls of the bores in the ball to interfere with the free action of the handle structure.

Still other features and advantages of the invention will appear from the following description, taken in connection with the accompanying drawings, wherein.

Figure 1:
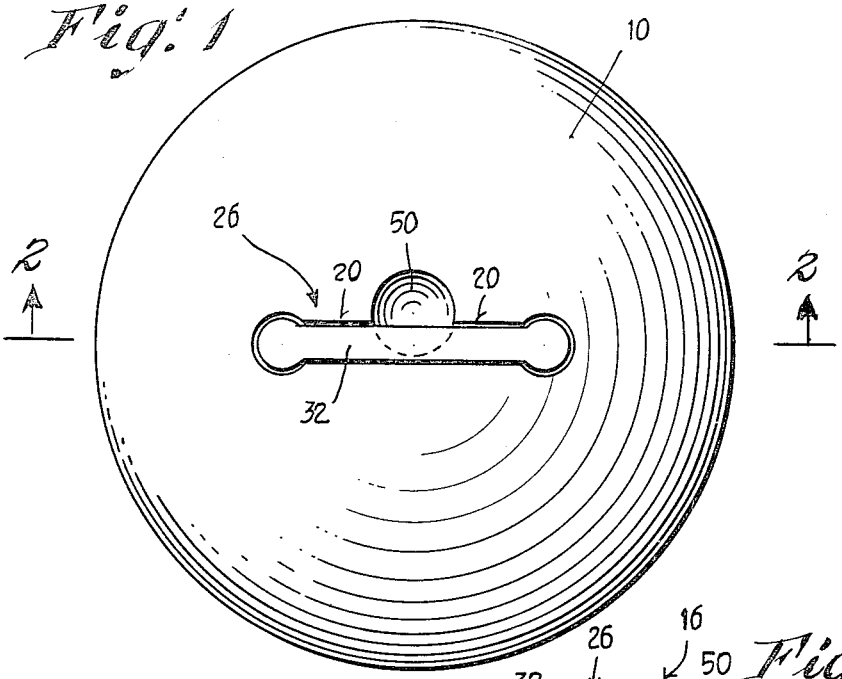
FIG. 1 is a top plan view of the improved easy-to-hold bowling ball of the invention, showing the handle structure in its retracted position.

As shown, the improved easy-grip bowling ball of the invention comprises a spherical ball body 10 having a pair of parallel, spaced-apart bores 12, 14 which are arranged in symmetrical relation with respect to an axis 16 of the body which passes through the center 18 of the ball.

The ball body 10 has an elongate recess or channel 20 in its surface, extending between the mouths 22, 24 of the bores.

Figure 2:
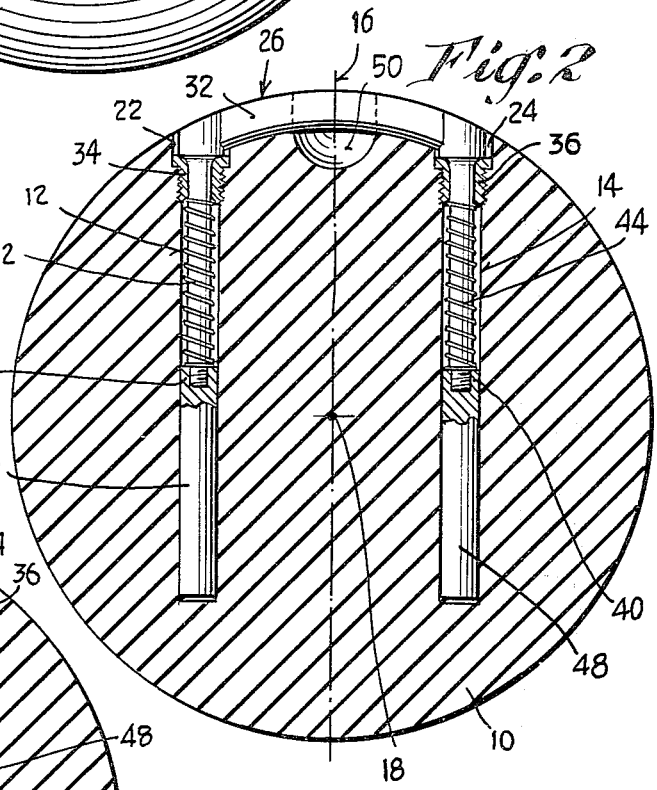
FIG. 2 is a diametric section taken on the line 2—2 of FIG. 1.

As provided by the invention, a generally U-shaped handle structure designated by the numeral 26 is utilized, comprising a pair of parallel leg portions 28, 30 and a yoke or hand grip portion 32 which extends between and joins the leg portions 28, 30. The leg portions 28, 30 are slidably movable in the bores 12, 14 of the body 10, and the yoke portion 32 is adapted to occupy the channel 20 so as to present a flush exterior surface on the body when the handle structure is in retracted position as shown in FIGS. 1 and 2.

Figure 3:
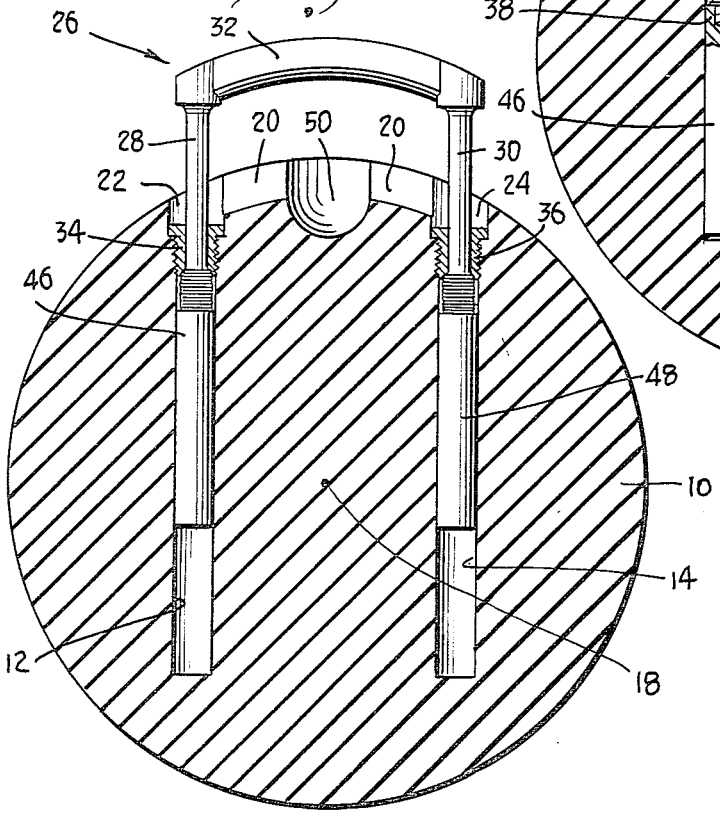
FIG. 3 is a section similar to that of FIG. 2 but showing the handle structure in its extended position.

Externally threaded bushings 34, 36 are carried by the leg portions 28, 30 respectively and are adapted to be screwed into threaded portions of the bores 22, 24 so as to provide slide bearings for the leg portions. Stops 38, 40 in the form of threaded nuts are carried by the leg portions 28, 30 at the extremities thereof, and extension coil springs 42, 44 encircle the leg portions 28, 30 respectively, said springs being engageable with the bushings 34,36 and with the stops 38, 40 so as to bias the handle structure 26 to the retracted position shown in FIGS. 1 and 2. The handle structure 26 is shiftable to an extended position as shown in FIG. 3 against the action of the coil springs 42, 44 whereby a convenient hand grip is provided for holding the ball body 10. Such hand grip enables partly disabled or infirm persons to hold and swing the ball, so as to throw it down an alley when engaging in the game of bowling.

In accordance with the present invention, unique means are provided to prevent inadvertent extending movement of the handle structure 26 during a rapid spinning of the ball, as for example, when it is being returned to the storage rack after having traversed the alley. Such means comprises counterweights 46, 48 which are carried by the leg portions 28, 30 and extend into the ball body 10 in the bores 22, 24 thereof. The counterweights 46,48 are disposed sufficiently deep to counteract the effect of centrifugal force on the handle structure 26 and minimize the tendency for the same to shift to its extended position against the action of the coil springs 42, 44 as the ball body 10 is rapidly spinning. Such movement of the ball body can occur during its return travel, along the usual return rails that are provided for such purpose. The counterweights 46, 48 are preferably made integral with the stops or nuts 38, 40, these both being machined from bar stock which can be cut into short lengths or rods. The bar stock is preferably of metal whereby it has a significant weight. Also, preferably the handle structure 26 comprising the leg portions 28, 30 and the yoke portion 32 is molded of a tough, resilient plastic substance whereby it has relatively little weight while at the same time exhibiting a considerable amount of strength to prevent its failure. The inner extremities of the leg portions 28, 30 are externally threaded and are received in the threaded bores of the nuts 38, 40. In order to enable the handle structure 26 to be conveniently lifted for the purpose of holding or swinging the ball, a recess 50 is provided in the body 10, which communicates with the channel 20 that nests the handle yoke portion 32. The recess 50 is sufficiently deep, as seen in FIG. 2, to enable a finger to be easily inserted under the yoke portion.

Further, in accordance with the present invention, an improved and simplified stop means is provided, which functions during the extended movement of the handle structure 26 to remove any deforming force which could tend to affect the coil springs 42, 44. Such stop means comprises integral abutment collars 52 which can be provided on the stop nuts that are threaded onto the leg portions 28, 30. The collars 52 project in an upward or outward direction from the nuts (which are labeled **38*a* in FIG. 5) and encircle parts of the leg portions 28, 30 so as to enclose the retracted coil springs when these are fully compressed for the extended position of the handle structure 26**.

Figure 4:
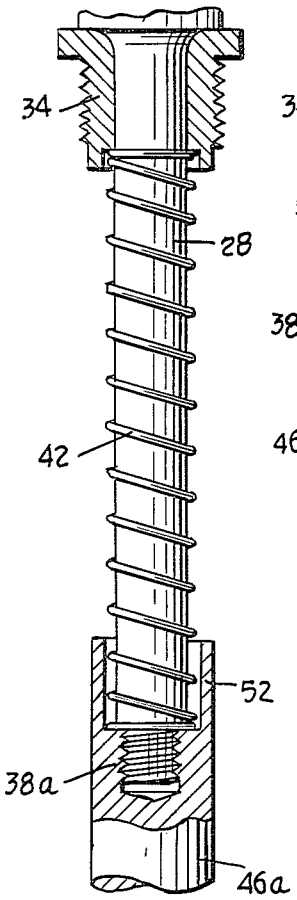
FIG. 4 is a fragmentary detail, partly in section and partly in side elevation, illustrating another embodiment of the invention wherein positive stops are provided on the counterweights, encircling portions of the retracting coil springs. This view illustrates the retracted position of the handle structure.
Figure 5:
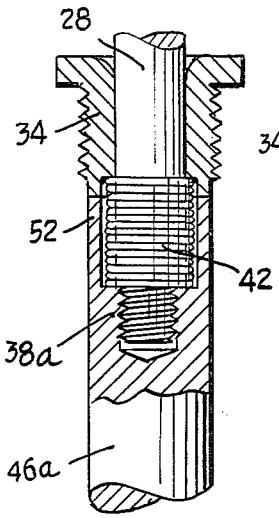
FIG. 5 is a view partly in elevation and partly in section, of a portion of the handle structure similar to that shown in FIG. 4 but illustrating the fully-extended position of the handle structure.

The abutment collars are adapted to engage the threaded bushings 34, 36 that are screwed into the ball body 10. As seen in FIGS. 4 and 5, the collars 52 are formed to be integral with the stop nuts **38*a* and also with the counterweights 46*a* whereby these can all be readily machined from ordinary metal bar stock. With such arrangement there is eliminated the need for separate abutment sleeves, such as were heretofore employed for the purpose of relieving any deforming stress on the coil springs when the handle structure was fully extended. The abutment collars 52, in engaging the bushings 34, 36 provide for a precise extending movement of the handle structure 26**, as can now be readily understood.

Figure 6:
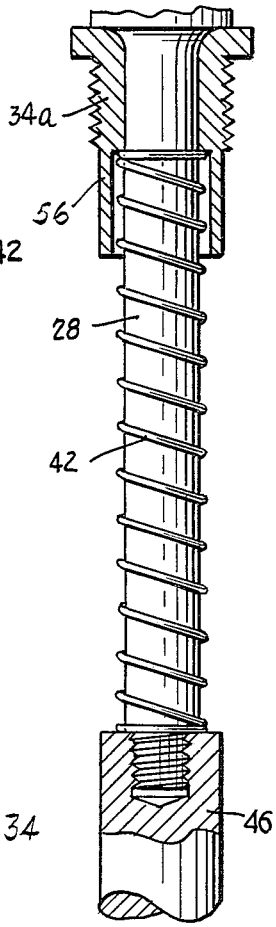
FIG. 6 is a fragmentary view partly in elevation and partly in axial section, illustrating portions of the handle structure and counterweight together with the bearing bushings which are so constituted as to provide positive stops for the extended position of the handle structure.
Figure 7:
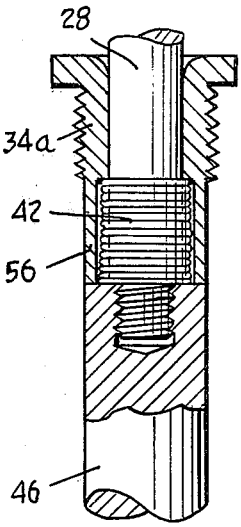
FIG. 7 is a view like that of FIG. 6 but showing the parts when the handle structure is in its extended position.

Another embodiment of the invention is illustrated in FIGS. 6 and 7, wherein modified bearing bushings **34*a* are provided, having depending skirt portions 56 which are integral with the bushings and which are adapted to completely encircle the coil springs 42,44 when the latter are fully compressed as seen in FIG. 7. For such condition the coil springs are securely held against lateral displacement and deformation, and the skirts 56 engage the ends of the counterweights 46** to constitute positive stops which relieve excessive, deforming forces which would otherwise be experienced by the coil springs. Parts similar to those already described above have been given the same reference numerals.

Figure 8:
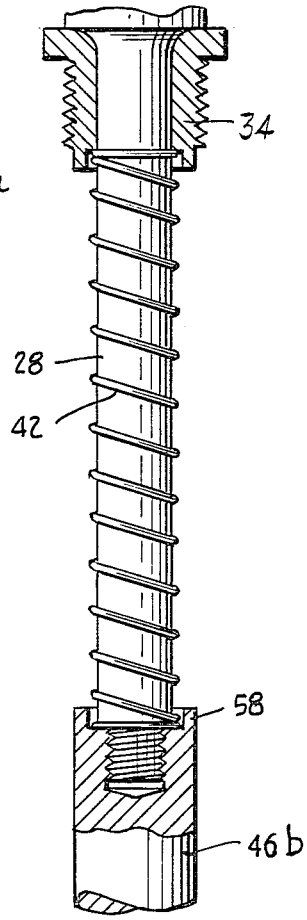
FIG. 8 is a view like that of FIG. 6 but illustrating another embodiment of the invention wherein the counterweights are fashioned to provide seats for the cooperable ends of the coil springs.

Still another embodiment of the invention is illustrated in FIG. 8, wherein the counterweights **46*b* are provided with annular, integral flanges 58 which provide seats for the inner ends of the coil springs 42. Thus, as seen in FIG. 8, both ends of the coil springs have seats to precisely position the ends, one seat on each leg portion being provided in the bearing bushing 34 and the other seat being provided in the counterweight 46*b* by means of the annular flange 58**.

It will now be seen from the foregoing that I have provided a novel and improved, easy-grip bowling ball wherein an extendable, U-shaped handle is counterweighted to neutralize the effect of centrifugal force during a rapid spinning of the ball. Also, the counterweights or bushings are so formed as to provide abutment collars which tend to effect a precise extended position of the handle structure, and to minimize deformation of biasing springs thereof. The construction is seen to be especially simple, involving relatively few parts which can be economically fabricated and assembled. Moreover, the construction is rugged and durable and is not likely to malfunction over an extended period of use.

Variations and modifications are possible without departing from the spirit of the claims.

I claim:

1. An easy-grip bowling ball comprising, in combination:

(a) a spherical ball body having a pair of parallel, spaced-apart bores arranged in symmetrical relation with respect to an axis of the body, (b) said body having a channel in its surface, extending between the mouths of said bores, (c) a generally U-shaped handle structure comprising a pair of parallel leg portions and a yoke portion extending between and joining said leg portions, (d) said leg portions of the handle structure being slidably movable in the bores of said body and the yoke portion of the handle structure being adapted to occupy the said channel so as to present a flush exterior surface of the body, (e) bushings carried by said leg portions, slidable thereon and adapted to be secured in said body to provide bearings for the leg portions, (f) stops carried by said leg portions at the extremities thereof, (g) coil springs carried by said leg portions, engageable with said bushings and with said stops to bias the handle structure to a retracted position wherein the yoke portion thereof occupies the said channel in a flush condition, said handle structure being shiftable against the action of said springs to an extended wherein the yoke portion is accessible to be grasped, and (h) counterweights carried by said leg portions and extending into said body in the bores thereof, said counterweights being disposed sufficiently deep to counteract the effect of centrifugal force on the handle structure and minimize the tendency for the same to shift to its extended position against the action of said coil springs as the ball is rotated.

2. An easy-grip bowling ball as set forth in claim 1, wherein:

(a) the counterweights are integral with said stops.

3. An easy-grip bowling ball as set forth in claim 2, wherein:

(a) the counterweights are machined, bored and threaded from metal bar stock.

4. An easy-grip bowling ball as set forth in claim 2, wherein:

(a) the counterweights have integral abutment collars projecting in an outward direction past said stops and encircling parts of said leg portions, (b) said coil springs when fully compressed being completely receivable in said abutment collars and the latter being engageable with aid bushings when the handle structure is in extended position.

5. An easy-grip bowling ball as set forth in claim 4, wherein:

(a) the counterweights are formed of cylindrical metal rods.

6. An easy-grip bowling ball as set forth in claim 1, wherein:

(a) the counterweights extend axially beyond the leg portions of the handle structure.

7. An easy-grip bowling ball as set forth in claim 6, wherein:

(a) the counterweights are commensurate in length with said leg portions of the handle structure.

8. An easy-grip bowling ball as set forth in claim 1, wherein:

(a) the counterweights comprise solid, elongate cylindrical members having a diameter slightly less than the diameter of said bores.

9. An easy-grip bowling ball as set forth in claim 1, wherein:

(a) the counterweights are adapted to slidably engage the walls of said bores and maintain alignment of said leg portions of the handle structure in the said bores.

10. An easy-grip bowling ball as set forth in claim 5, wherein:

(a) the yoke portion and leg portions of the handle structure are integral with each other, and are molded of resilient plastic.

* * * * *